US009937708B2

(12) United States Patent
Mietus

(10) Patent No.: US 9,937,708 B2
(45) Date of Patent: Apr. 10, 2018

(54) MICRO-FIBER ANILOX ROLL CLEANING PLATE

(71) Applicant: Efficient Anilox Care, LLC, Hickory Hills, IL (US)

(72) Inventor: Dominik K. Mietus, Hickory Hills, IL (US)

(73) Assignee: Efficient Anilox Care, LLC, Hickory Hills, IL (US)

( * ) Notice: Subject to any disclaimer, the term of this patent is extended or adjusted under 35 U.S.C. 154(b) by 0 days.

(21) Appl. No.: 15/235,275

(22) Filed: Aug. 12, 2016

(65) Prior Publication Data

US 2017/0043571 A1 Feb. 16, 2017

Related U.S. Application Data

(60) Provisional application No. 62/204,196, filed on Aug. 12, 2015.

(51) Int. Cl.

| | |
|---|---|
| ***B41F 35/00*** | (2006.01) |
| ***B41F 35/06*** | (2006.01) |
| ***B41F 35/04*** | (2006.01) |

(52) U.S. Cl.

CPC ..... *B41F 35/06* (2013.01); *B41F 35/04* (2013.01); *B41P 2235/246* (2013.01); *B41P 2235/50* (2013.01)

(58) Field of Classification Search

CPC ..... B45F 35/06
USPC ..... 101/425
See application file for complete search history.

(56) References Cited

U.S. PATENT DOCUMENTS

| | | | | |
|---|---|---|---|---|
| 2,735,142 A * | 2/1956 | Noiles | D01H 5/64 | 15/256.52 |
| 3,998,681 A * | 12/1976 | Williams | B29C 70/14 | 101/348 |
| 4,492,012 A * | 1/1985 | Pala | B41F 35/00 | 29/895.32 |
| 5,383,404 A * | 1/1995 | Nambu | B41F 35/00 | 101/416.1 |
| 6,030,674 A * | 2/2000 | Onishi | B08B 7/0028 | 15/256.51 |
| 6,381,427 B1 * | 4/2002 | Bertram | G03G 21/0035 | 15/256.52 |
| 6,594,457 B2 * | 7/2003 | Tsutsumi | G03G 15/161 | 15/256.52 |

(Continued)

FOREIGN PATENT DOCUMENTS

EP 1291180 A1 3/2003

OTHER PUBLICATIONS

Search Report and Written Opinion for corresponding EP Application No. 16183870 filed Aug. 11, 2016; dated Nov. 2, 2016; 39 pages.

*Primary Examiner* — Anthony Nguyen
(74) *Attorney, Agent, or Firm* — Richards Patent Law P.C.

(57) ABSTRACT

A micro-fiber cleaning plate comprising: a micro-fiber sheet including fibers that extend outward from a surface of the microfiber sheet in a uniform direction; a leading edge locking strip connected to the micro-fiber sheet along a first edge; and a rear edge locking strip connected to the micro-fiber sheet along a second edge opposite the first edge, wherein the leading edge locking strip engages to the rear edge locking strip to secure the micro-fiber cleaning plate to a roll of an anilox print system.

16 Claims, 4 Drawing Sheets

(56) References Cited

U.S. PATENT DOCUMENTS

| | | | | |
|---|---|---|---|---|
| 6,951,044 | B2 * | 10/2005 | Kaim | B08B 1/02 101/425 |
| 2003/0046785 | A1 | 3/2003 | Shiroki et al. | |
| 2004/0173240 | A1 * | 9/2004 | Harris | B08B 1/007 134/2 |
| 2007/0140756 | A1 * | 6/2007 | Callis | G03G 15/2025 399/327 |
| 2007/0221248 | A1 * | 9/2007 | Boatman | A46B 11/063 134/6 |

* cited by examiner

MICRO-FIBER ANILOX ROLL CLEANING PLATE

CROSS-REFERENCE TO RELATED APPLICATIONS

This application incorporates by reference and claims the benefit of priority to U.S. Provisional Patent Application No. 62/204,196 filed Aug. 12, 2015.

BACKGROUND OF THE INVENTION

The present subject matter relates generally to a systems and methods for cleaning printing rolls. More specifically, the present invention relates to a micro-fiber anilox cleaning plate that may be used to clean an anilox roll with minimal downtime and expense.

Anilox Rolls are used in several printing industries like offset printing, process printing and flexography or "flexo" printing to provide a measured amount of ink to a printing plate. An anilox roll is a hard cylinder, usually constructed of a steel or an aluminum core which is coated by an industrial ceramic whose surface contains millions of very fine dimples, known as cells. Depending on the design of the printing press, the anilox roll is either semi-submerged in the ink fountain, or comes into contact with a so-called metering roller, which is semi-submerged in the ink fountain. The anilox roll then rotates to contact with the printing plate to receive the ink for transfer to the printed material.

A serious problem plaguing anilox rolls is the tendency of the cells of the roll to slowly fill and become plugged with dry ink. Anilox rollers that are used with water, solvent and oil based inks must be cleaned immediately after use or a problem known as plugging occurs, where minuscule amounts of ink dry in the cells. The presences of dry ink in the cells causes tiny, but unacceptable, pinholes in anything printed from the roll in the future. Accordingly, proper maintenance of anilox rolls requires regular cleaning to maintain print quality.

By their nature, anilox rolls are difficult to clean. Anilox rolls are incorporated into large presses with large numbers of parts that must be present near the roll for operation. This limits access to the roll for the purposes of cleaning. Additionally, large anilox rolls may be only movable by crane, making it difficult to remove a roll for cleaning. Even for small rolls, extreme caution must be taken when handling these pieces of hardware. A single bump against a hard surface or sharp corner can destroy the delicate cell structure on the surface and render a roller completely useless, at a cost of around US$5000 for even small narrow-web rollers. Accordingly, methods of cleaning anilox rolls in place are preferred.

One previous method of cleaning anilox rolls in place is the use of brushes. Using brushes on anilox rolls has risks; it is important not to use the wrong type of brush on a roll. Nicks and scratches cause by a brush may add up quickly, so fine brushes (never brass brushes) are used for cleaning the anilox roll. For anilox rolls with special coatings, manufacturers may recommend against using brushes altogether. Additionally, the bristle tips of a brush are generally larger than the cells of anilox rollers used in most flexo printing. Thus, the bristles do not get into the cells, and brushing only breaks the film of ink on top of the cell walls, potentially leaving ink deposited within the cells.

Previous approaches to cleaning anilox rolls faced serious drawbacks and tradeoffs. Common cleaning methods have included: baking soda blast, plastic bead blast, dry ice blast, ultrasonic (small rolls only) and chemicals. Each of these approaches has advantages and disadvantages. Common disadvantages include expensive or time-consuming cleaning, the need to remove the anilox roll from the press, and importantly, the need for downtime to perform the cleaning. Thus, there is a need for easy-to-use, down-time free (that is, it may be used during production), inexpensive, alternative way to clean wide web anilox rolls.

Accordingly, there is a need for micro-fiber cleaning plate and systems and methods for cleaning anilox rolls, as described herein.

BRIEF SUMMARY OF THE INVENTION

To meet the needs described above and others, the present disclosure provides a micro-fiber cleaning plate and systems and methods for cleaning anilox and other printing rolls. The micro-fiber cleaning plate may include micro-fibers (also known as micro-fibre) that extend outward from the surface of the plate to engage with and clean the surface of the anilox roll.

In an embodiment, the micro-fiber anilox cleaning plate may be installed on the plate cylinder to clean an anilox roll. The micro-fiber anilox cleaning plate may be mounted in the same manner as a printing plate, for example, the micro-fiber anilox cleaning plate may include a leading edge locking strip to hold the cleaning plate to the plate cylinder.

Once the cleaning plate is installed, the press may then be run, as if a print job was being run, to permit the micro-fiber cleaning plate to come into contact with the anilox roll as they rotate. A detergent cleaner may be used in substitution for the ink to further assist the cleaning action. As the rolls turn, micro-fibers on the surface of the micro-fiber cleaning plate come into contact with the cells of the anilox roll and scour out dried ink.

In an embodiment, the micro-fiber anilox cleaning plate may include a micro-fiber sheet. The micro-fiber sheet may include fibers that extend outward from the surface of the micro-fiber sheet to engage with and clean the surface of the anilox roll. In an embodiment, a fiber diameter of a fiber of the micro-fiber is approximately fifty microns. In another embodiment, a fiber diameter of a fiber is in the range of fifty to one hundred microns. Since one anilox roll cell is approximately 100 microns, the mechanical action of the relative rotation of the anilox roll and the cleaning plate may force the fibers into the cells to remove dried ink within.

In an embodiment, the micro-fiber anilox cleaning plate may include a 0.0030" (0.76 mm) PVC mounting plate. On one end the mounting plate may include a leading edge locking strip, with a trailing edge locking strip on the opposite edge. In some embodiments, the trailing edge locking strip may be omitted and the micro-fiber anilox cleaning plate may be secured on that edge with tape or a rubber fastener. In an embodiment, the total thickness of the micro-fiber cleaning plate is between 0.185" to 0.300". In another embodiment, the total thickness of the micro-fiber cleaning plate is between 0.185" to 0.280" (4.57 mm to 7.11 mm). In some embodiments, the total thickness of the micro-fiber cleaning plate is 0.160" or greater and may omit the bottom padding and the mounting plate along most of the micro-fiber sheet to achieve the desired thickness.

The length of the fibers may be chosen to trade-off stiffness, penetrating depth, and to maximize contact. In an embodiment, the fibers have a height between 1 mm and 1.5 mm. In a preferred embodiment, the microfiber sheet may be a modified sheet of Flotex brand micro-fiber flooring material having approximately 70 million fibres/$m^2$. In the preferred embodiment, the height of the micro-fibers are shaved down from 2.1 mm to between 1 mm and 1.5 mm to increase stiffness and to achieve a desired height, leaving a total thickness of the microfiber sheet of approximately 0.110" (2.79 mm). By shaving down the micro-fibers, they become more firm and abrasive to help further penetrate deep into the anilox roll cells. In other embodiments, where less stiffness is desired or less height is needed, the height of the micro-fibers may be between 1.5 mm and 2.1 mm.

Additionally, in an embodiment, the micro-fibers may be slightly angled from the vertical direction. For example, in an embodiment, the micro-fibers may be angled between zero to twenty degrees from the vertical. In a preferred embodiment, the micro-fibers are angled at approximately ten degrees from the vertical. The direction in which the fibers are angled is the leading edge of the microfiber sheet. In an embodiment, the leading edge is oriented along the direction of rotation of the plate cylinder to increase the likelihood of the penetration of the anilox cells.

On one side of the cleaning plate, extra cushioning in the form of bottom padding may be present. The bottom padding may be secured using glue, or otherwise bonded to the cleaning plate. The exact thickness of the micro-fiber anilox cleaning plate may be chosen by varying the thickness of the bottom padding to size it for the particular machine it is being used on. In some embodiments, the bottom padding may be omitted to minimize the thickness of the micro-fiber anilox cleaning plate. In some embodiments, the bottom padding may be any thickness in the range of negligible thickness (such as omitting the padding) up to a thickness of 0.100" (2.54 mm). Likewise, the width and diameter dimensions may be varied based on the size of the anilox roll.

In an embodiment, a micro-fiber cleaning system may be embodied in an anilox printing system including a micro-fiber cleaning roll. The anilox printing system may include an impression cylinder, a plate cylinder, an anilox roll, a micro-fiber cleaning roll, and metering and doctor blades for the application of ink.

The micro-fiber cleaning roll may be mounted next to anilox roll. To clean the anilox roll, a micro-fiber anilox cleaning plate may be attached to the micro-fiber cleaning roll and secured at a locking notch. Detergent may be run through the ink supply system to enhance the cleaning. To resume printing, the micro-fiber anilox cleaning plate may be disengaged from the anilox roll to permit the anilox roll to operate normally.

In an embodiment, a micro-fiber cleaning plate includes: a micro-fiber sheet including fibers that extend outward from a surface of the microfiber sheet such that each fiber is uniformly oriented relative to a normal vector of the surface at a point where the respective fiber is attached to the micro-fiber sheet; a leading edge locking strip connected to the micro-fiber sheet along a first edge; and a rear edge locking strip connected to the micro-fiber sheet along a second edge opposite the first edge, wherein the leading edge locking strip engages to the rear edge locking strip to secure the micro-fiber cleaning plate to a roll of an anilox print system.

In an embodiment, the micro-fiber cleaning plate further includes a cushioning layer connected to the micro-fiber cleaning plate parallel to the surface of the micro-fiber sheet. In an embodiment, the fiber diameter is approximately fifty microns.

Additionally, in an embodiment, the fiber diameter is in the range of fifty to one hundred microns. Moreover, in an embodiment, the total thickness of the micro-fiber cleaning plate is between 0.185 and 0.300 inches.

In an embodiment, the total thickness of the micro-fiber cleaning plate is between 0.185 to 0.280 inches. Additionally, in an embodiment, the fiber height is between one millimeter and one-and-a-half millimeters. Moreover, in an embodiment, the micro-fiber sheet includes between sixty to eighty million fibers per square meter. Further, in an embodiment, the height of the micro-fibers is between one-and-a-half and two-and-one-tenths millimeter.

In an embodiment, each fiber is oriented at an angle along the direction of rotation relative to the normal vector. For example, in an embodiment, the angle is between five degrees and twenty degrees. And, in one embodiment, the angle is ten degrees.

An object of the invention is to provide a system to clean, maintain, and prolong anilox roll life that is crucial in flexographic printing.

An advantage of the invention is that it provides a micro-fiber cleaning plate that is an easy-to-use, down-time free (that is, it may be used during production), inexpensive, alternative way to clean wide web anilox rolls.

Another advantage of the invention is that it provides a micro-fiber cleaning plate that may extend the life and improve the printing quality of an anilox roll via preventative maintenance.

A further advantage of the invention is that it provides a micro-fiber cleaning plate that is very durable and it is designed for repeated use.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1A:
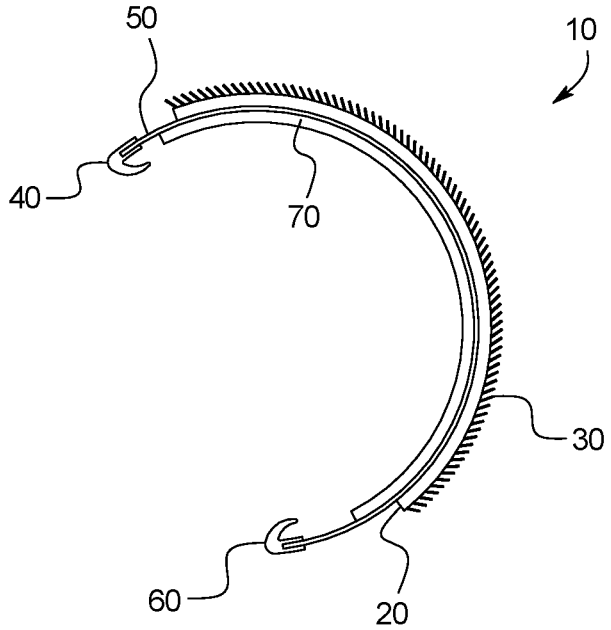
FIG. 1A illustrates an example of a micro-fiber cleaning plate including a leading edge locking strip and a trailing edge locking strip.
Figure 1B:
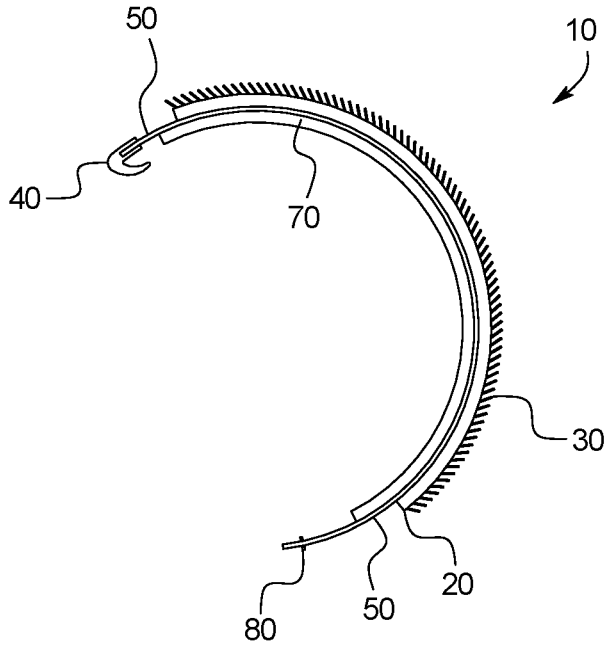
FIG. 1B illustrates an example of a micro-fiber cleaning plate lacking a trailing edge locking strip.

FIGS. 1A and 1B illustrates an example of a micro-fiber cleaning plate 10 for cleaning anilox and other printing rolls.

Figure 2:
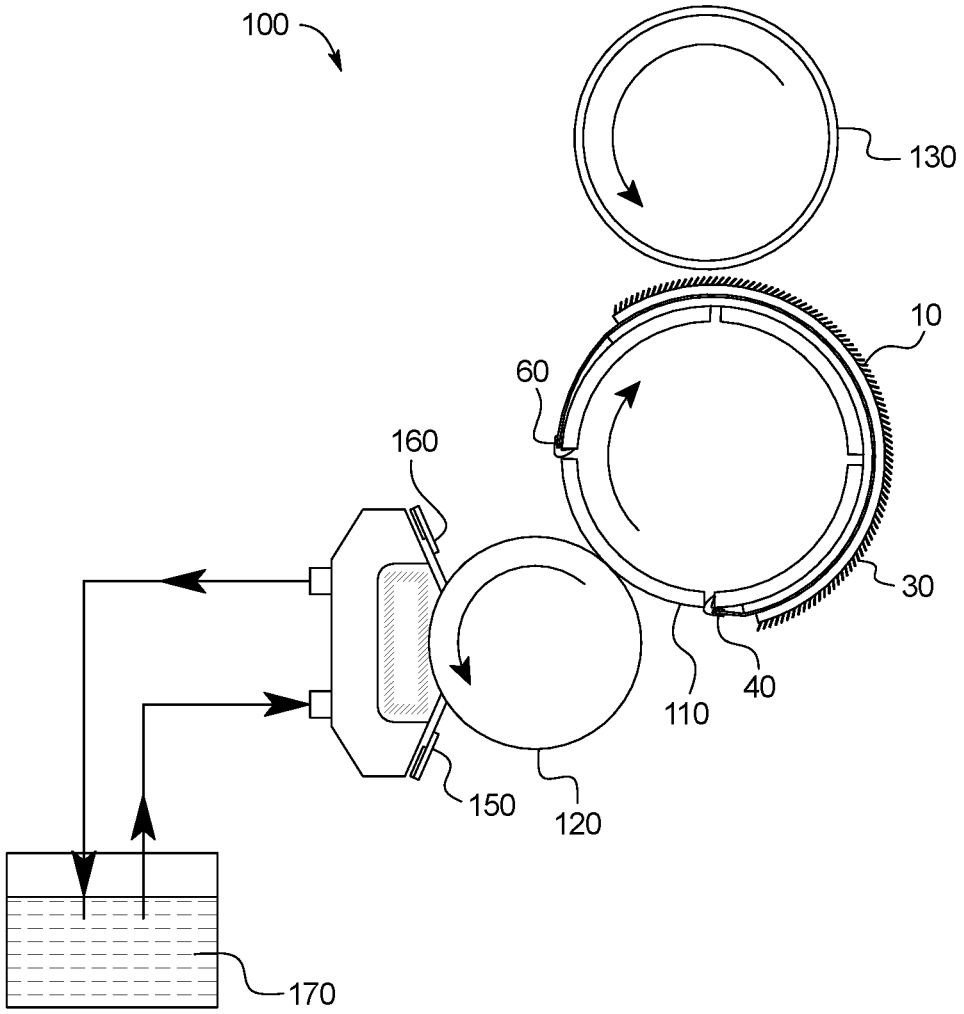
FIG. 2 illustrates a printing system in which the micro-fiber anilox cleaning plate is installed on a plate cylinder to clean an anilox roll.

As shown in FIG. 1A, the micro-fiber cleaning plate 10 includes a micro-fiber sheet 20 including micro-fibers 30 (also known as micro-fibre). As shown in FIG. 2, in an embodiment, the micro-fiber anilox cleaning plate 10 may be installed on a plate cylinder 110 of a printing system 100 to clean an anilox roll 120.

In an embodiment, the micro-fiber anilox cleaning plate 10 may include a micro-fiber sheet 20. The micro-fiber sheet 20 may include micro-fibers 30 that extend radially outward in a uniform direction when mounted on a plate cylinder 110 for cleaning. The micro-fibers 30 may engage with and clean the surface of the anilox roll 120. In an embodiment, the micro-fiber sheet 20 may include approximately seventy million 100% nylon fibers per square meter. And, in an embodiment, the micro-fiber sheet 20 has a height of 2.1 mm (0.083") with an intermediate fiberglass layer and a recycled closed cell vinyl cushioned backing with total thickness (micro-fiber and cushion) of 0.17" (4.3 mm).

The micro-fiber cleaning plate 10 may be mounted in the same manner as a printing plate cylinder 110, for example, the micro-fiber cleaning plate 10 may include a leading edge locking strip 40 to hold the cleaning plate 10 to the plate cylinder 110.

As shown in FIG. 1A, the micro-fiber anilox cleaning plate 10 may include a 0.0030" (0.76 mm) PVC mounting plate 50. In the embodiment shown, the Micro-fiber sheet 20 is mounted to the PVC mounting plate 50. The mounting plate 50 may include a surface area that is larger than the micro-fiber sheet 20 to fully secure it. In an embodiment, the mounting plate 50 is stiffer than the microfiber sheet 50 and has a curved shape. Accordingly, in some embodiments, when including the mounting plate 50, the micro-fiber cleaning plate 10 is naturally curved to cylinder shape by the curve of the mounting plate 50. The micro-fiber anilox cleaning plate 10 including a mounting plate 50 may be used for bigger circumference 86", 66" and 50" rolls.

On one end the mounting plate may include a leading edge locking strip 40, with a trailing edge locking strip 60 on the opposite edge. In some embodiments, as shown in FIG. 1B, the trailing edge locking strip 60 may be omitted and the micro-fiber cleaning plate 10 may be secured on that edge with tape or a rubber fastener. The width and circumference of the micro-fiber plate 10 may be made to machine print cylinder specification. In an embodiment, the total thickness of the micro-fiber cleaning plate 10 is between 0.185" to 0.300". In another embodiment, the total thickness of the micro-fiber cleaning plate 10 is between 0.185" to 0.280" (4.57 mm to 7.11 mm).

In an embodiment, no double faced tape, adhesives or glue is required to stick the micro-fiber cleaning plate 10 to the plate cylinder 110 because the plate is equipped with a leading edge locking strip including T-bar or J-bar mounting strip for securing the the micro-fiber cleaning plate 10 to the plate cylinder 110 quickly and easily. In some embodiments, the micro-fiber cleaning plate 10 may also be made with 0.0925 inch thick, or 0.500 inch width, 92 inch length mounting strips for the leading edge locking strip 40 and the trailing edge locking strip 60. And, in some embodiments, the trailing edge locking strip 60 has either T-bar/J-bar mounting strip or ⅛"×1½" slotted trailing edge strip for quickly securing the plate 10 to plate cylinder 110. Additionally, in some embodiments, the leading/trail edges of the Micro-Fiber are sealed with "Green die sealer". Further, the T-bar/J-bar mounting strips may be stuck (for example, using two sided tape) and sewed to 0.030" PVC or Polyester 0.014" Mylar carrier.

On one side of the micro-fiber cleaning plate 10, extra cushioning in the form of bottom padding 70 may be present. The bottom padding 70 may be secured using glue, or otherwise bonded to the micro-fiber cleaning plate 10 on the side opposite the micro-fiber sheet 20. The exact thickness of the micro-fiber cleaning plate 10 may be chosen by varying the thickness of the bottom padding 70 to size it for the particular machine it is being used on. In some embodiments, the bottom padding 70 may be omitted to minimize the thickness of the micro-fiber cleaning plate 10. In some embodiments, the bottom padding 70 may be any thickness in the range of negligible thickness (such as omitting the padding) up to a thickness of 0.100" (2.54 mm). Likewise, the width and diameter dimensions may be varied based on the size of the anilox roll 120. In some embodiments, the bottom padding 70 may be placed between the micro-fiber sheet 20 and the mounting plate 50.

For example, in an embodiment, the micro-fiber sheet 20 is glued and sewed to a 0.030" PVC layer underneath the entire micro-fiber sheet 20 plus extra inches for both a leading edge locking strip 40 and a trailing edge locking strip 60. In another embodiment, the micro-fiber sheet 20 is glued and sewed to a polyester 0.014" Mylar layer. The Micro-Fiber may be glued and sewed to compressible cushion plate backing foam material of variable thickness (for example, in various embodiments, 0.090", 0.100" or 0.120" inches thick) for height control contingent on the machine specification. Total thickness of a finished micro-fiber cleaning plate 10 may be between 0.180" to 0.280".

Turning back to FIG. 2, the micro-fiber anilox cleaning plate 10 may be installed on a plate cylinder 110 of a printing system 100 to clean an anilox roll 120. Once the cleaning plate 10 is installed, the printing system 100 may then be run, as if a print job was being run, to permit the micro-fiber cleaning plate 10 to come into contact with the anilox roll 120 as they rotate. A detergent cleaner 170 may be used in substitution for the ink to further assist the cleaning action. As the rolls turn, micro-fibers on the surface of the micro-fiber cleaning plate 10 come into contact with the cells of the anilox roll and scour out dried ink.

Figure 3:
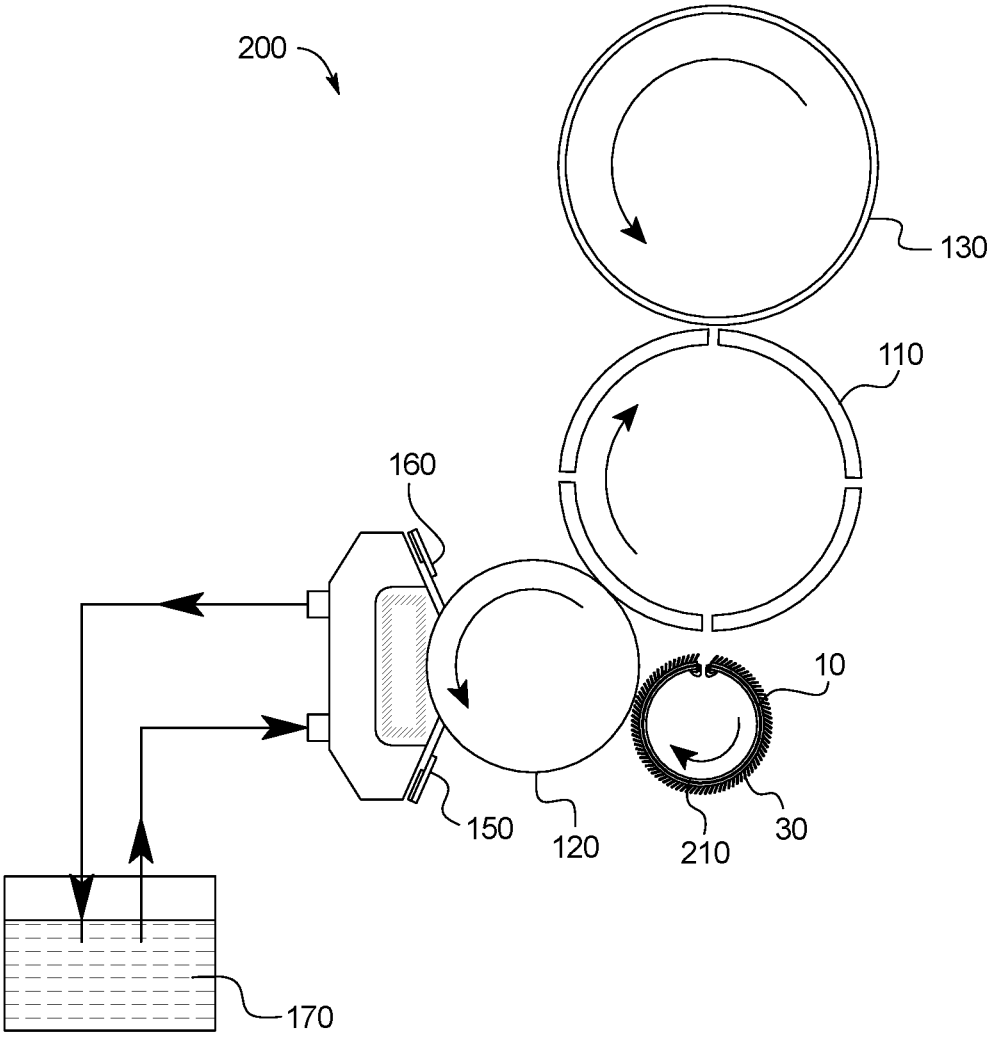
FIG. 3 illustrates a printing system with a microfiber cleaning roll in which the micro-fiber anilox cleaning plate is installed on a microfiber cleaning roll to clean an anilox roll.

In some embodiments, the invention may be embodied in an anilox printing system with a special purpose micro-fiber cleaning roll ("anilox printing system 200"), as shown in FIG. 3. As shown in FIG. 3, the anilox printing system 200 may include an impression cylinder 130, a plate cylinder 110, an anilox roll 120, a micro-fiber cleaning roll 210, metering blades 150 and doctoring blades 160 for the application of ink.

The micro-fiber cleaning roll 210 may be mounted next to anilox roll 120. To clean the anilox roll 120, a micro-fiber anilox cleaning plate 10 may be attached to the micro-fiber cleaning roll 210 and secured at a locking notch. Detergent 170 may be run through the ink supply system to enhance the cleaning. To resume printing, the micro-fiber cleaning plate 10 may be removed from the micro-fiber cleaning roll 210.

Figure 4:
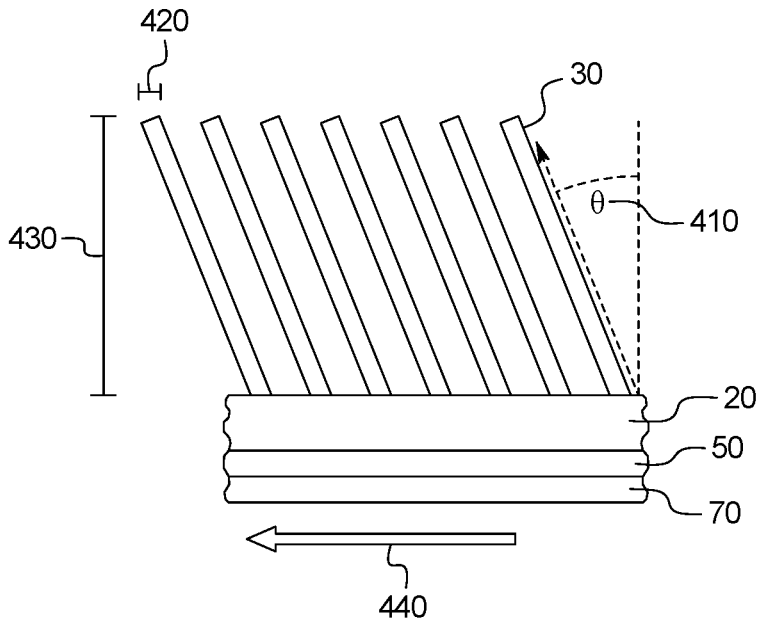
FIG. 4 illustrates a cross-sectional view of a portion of a microfiber cleaning plate illustrating the orientation and angle of the micro-fibers.

Turning to FIG. 4, shown is a cross-sectional view of a microfiber cleaning plate 10 to illustrate the orientation, size, and other properties of the micro-fibers (FIG. 4 is not shown to scale.) In an embodiment, a fiber diameter 420 of a micro-fiber 30 is approximately fifty microns. In another embodiment, a fiber diameter 420 of a micro-fiber 30 is in the range of fifty to one hundred microns. Since one anilox roll cell is approximately 100 microns, the mechanical action of the relative rotation of the anilox roll 120 and the plate cylinder 110 or the micro-fiber cleaning roll 210 may force the micro-fibers 30 into the cells to remove dried ink within.

A micro-fiber height 430 of the micro-fibers 30 may be chosen to trade-off stiffness, penetrating depth, and to maximize contact. In an embodiment, the micro-fibers have a micro-fiber height 430 between one millimeter and one and a half millimeters. In a preferred embodiment, the microfiber sheet 20 may be a modified sheet of Flotex brand micro-fiber flooring material having approximately 70 million fibers/$m^2$. In the preferred embodiment, the micro-fiber height 430 of the micro-fibers are shaved down from two and one tenth millimeters to between one millimeter and one and a half millimeters to increase stiffness and to achieve a desired height, leaving a total thickness of the microfiber sheet of approximately 0.110" (2.79 mm). By shaving down the micro-fibers, they become more firm and abrasive to help further penetrate deep into the anilox roll cells. In other embodiments, where less stiffness is desired or less height is needed, the height of the micro-fibers 30 may be between one and a half millimeters mm and two and one tenth millimeters.

Additionally, in an embodiment, the micro-fibers 30 may be slightly angled at a micro-fiber angle 410 that is measured from the normal vector of the surface of the micro-fiber sheet 20. (The normal vector is a vector that points radially outwards from the origin of a circle defined by the cross-section of the roll.) For example, in an embodiment, the micro-fibers 30 may be angled at a micro-fiber angle 410 between zero to twenty degrees from the normal vector. In a preferred embodiment, the micro-fibers are angled at a micro-fiber angle 410 that is between eight and twelve degrees—that is, approximately ten degrees from the normal vector. The direction in which the fibers are angled is the leading edge of the microfiber sheet 20. In an embodiment, the leading edge is oriented along the direction of rotation 440 of the plate cylinder 110 or the microfiber-cleaning roll 210 to increase the likelihood of the penetration of the anilox cells.

Figure 5:
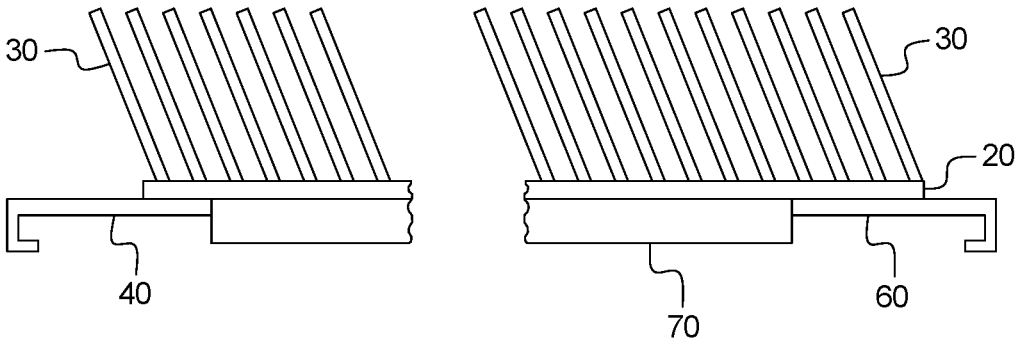
FIG. 5 illustrates a cross-sectional view of the leading and trailing edges of a microfiber cleaning plate that does not include a mounting plate.

The micro-fiber cleaning plate 10 of FIG. 5 omits a mounting plate 50 extending from the leading edge locking strip 40 to the trailing edge locking strip 60. By omitting the mounting plate 50, these embodiments have increased flexibility for printing systems 100 with smaller diameter rolls. As shown in FIG. 5, the cleaning plate 10 may include a foam cushion bottom padding 70 to control the height of the cleaning plate 10, and may include 0.010" to 0.015" Polyester Base Film Carrier Sheet at the leading and trail edge but not in the middle to increase flexibility.

The flexible cleaning plate 10 of FIG. 5 may include polyester 0.014" Mylar carrier built into only the front (lead edge) and back (trailing edge) with only the micro-fiber sheet 20 and a compressible cushion plate backing foam material, the bottom padding 70, in between. By omitting the mounting plate 50, the cleaning plate 10 has increased flexibility for the smaller diameter rolls such as 37" circumference and smaller.

It should be noted that various changes and modifications to the presently preferred embodiments described herein will be apparent to those skilled in the art. Such changes and modifications may be made without departing from the spirit and scope of the present invention and without diminishing its attendant advantages.

The invention claimed is:

1. A micro-fiber cleaning plate comprising:

a micro-fiber sheet including a sheet body and a plurality of fibers that extend outward from a surface of the sheet body at a uniform angle relative to a normal vector extending from the surface of the sheet body;

a leading edge locking strip connected to the micro-fiber sheet along a first edge; and a rear edge locking strip connected to the micro-fiber sheet along a second edge opposite the first edge, wherein the leading edge locking strip and the rear edge locking strip removeably engage with a roll of an anilox print system to secure the micro-fiber cleaning plate to the roll of the anilox print system.

2. The micro-fiber cleaning plate of claim 1, further including a cushioning layer connected to the micro-fiber cleaning plate parallel to the surface of the micro-fiber sheet.

3. The micro-fiber cleaning plate of claim 1, wherein the fiber diameter is approximately 0.05 mm.

4. The micro-fiber cleaning plate of claim 1, wherein the fiber diameter is in the range of 0.05 mm to 0.10 mm.

5. The micro-fiber cleaning plate of claim 1, wherein the total thickness of the micro-fiber cleaning plate is between 0.185 and 0.300 inches.

6. The micro-fiber cleaning plate of claim 1, wherein the total thickness of the micro-fiber cleaning plate is between 0.185 to 0.280 inches.

7. The micro-fiber cleaning plate of claim 1, wherein the fiber height is between one millimeter and one-and-a-half millimeters.

8. The micro-fiber cleaning plate of claim 1, wherein the micro-fiber sheet includes between sixty to eighty million fibers per square meter.

9. The micro-fiber cleaning plate of claim 1, wherein the height of the micro-fibers is between one-and-a-half and two-and-one-tenths millimeter.

10. The micro-fiber cleaning plate of claim 1, wherein the uniform angle is along the direction of rotation.

11. The micro-fiber cleaning plate of claim 1, wherein the uniform angle is between five degrees and twenty degrees.

12. The micro-fiber cleaning plate of claim 1, wherein the uniform angle is between 8 and 12 degrees.

13. The micro-fiber cleaning plate of claim 1, wherein the sheet body includes a fiberglass layer.

14. The micro-fiber cleaning plate of claim 1, wherein the leading edge locking strip and the rear edge locking strip include a J-bar locking strip to secure the micro-fiber cleaning plate to a roll of the anilox print system.

15. The micro-fiber cleaning plate of claim 1, wherein the leading edge locking strip and the rear edge locking strip include a T-bar locking strip to secure the micro-fiber cleaning plate to a roll of the anilox print system.

16. The micro-fiber cleaning plate of claim 1, wherein the leading edge locking strip and the rear edge locking strip are independently selected from a T-bar locking strip and a J-bar locking strip, wherein the leading edge locking strip and the rear edge locking strip removeably engage with at least one locking notch of the anilox print system to secure the micro-fiber cleaning plate to the roll of the anilox print system.

* * * * *